US011344766B1

(12) United States Patent
Bonder

(10) Patent No.: US 11,344,766 B1
(45) Date of Patent: May 31, 2022

(54) TRAINING DEVICE FOR SOCCER AND THE LIKE

(71) Applicant: ADX SPORT, LLC, Collingswood, NJ (US)

(72) Inventor: James Bonder, Collingswood, NJ (US)

(73) Assignee: ADX SPORT, LLC, Collingswood, NJ (US)

( * ) Notice: Subject to any disclaimer, the term of this patent is extended or adjusted under 35 U.S.C. 154(b) by 0 days.

(21) Appl. No.: 17/599,054

(22) PCT Filed: Feb. 8, 2021

(86) PCT No.: PCT/US2021/016993

§ 371 (c)(1),
(2) Date: Sep. 28, 2021

(87) PCT Pub. No.: WO2021/178106

PCT Pub. Date: Sep. 10, 2021

Related U.S. Application Data

(60) Provisional application No. 62/984,341, filed on Mar. 3, 2020.

(51) Int. Cl.
*A63B 21/00* (2006.01)
*A63B 43/00* (2006.01)

(52) U.S. Cl.
CPC ..... *A63B 21/4015* (2015.10); *A63B 43/005* (2013.01); *A63B 2209/10* (2013.01)

(58) Field of Classification Search
CPC ..... A63B 21/4015; A63B 43/005; A63B 2209/10
See application file for complete search history.

(56) References Cited

U.S. PATENT DOCUMENTS 5,851,161 A * 12/1998 Sassak ..... A63B 41/08 473/568
2015/0033585 A1* 2/2015 Otus ..... A43B 5/025 36/109
2015/0209639 A1* 7/2015 Bishop ..... A63B 69/002 473/424
2018/0110299 A1* 4/2018 Kokkoris ..... A41B 11/00
2018/0130374 A1* 5/2018 Hilley ..... A43B 3/30

* cited by examiner

*Primary Examiner* — Joshua Lee
(74) *Attorney, Agent, or Firm* — Mendelsohn Dunleavy, P.C.; Steve Mendelsohn

(57) ABSTRACT

In certain embodiments, a training device for soccer (European-styie football) has an upper portion configured to be wrapped around an athlete's lower leg and a lower portion configured to be secured onto a shoe worn on the athlete's foot below the lower leg, wherein an outer surface of at least one of the upper and lower portions has a first material configured to mate with a second material on an outer surface of a ball, such that, when the athlete attempts to kick the bail with the foot, the ball will tend to stick to the training device due to mating of the first and second materials (e.g., forming a hook-and-loop assembly). By wearing the training device on the athlete's dominant leg, the athlete learns to kick with their non-dominant leg, thereby becoming a more well-rounded soccer player.

21 Claims, 3 Drawing Sheets

TRAINING DEVICE FOR SOCCER AND THE LIKE

CROSS-REFERENCE TO RELATED APPLICATIONS

This application claims the benefit of the filing date of PCT application no. PCT/US2021/016993, filed on Feb. 8, 1921, which claims the benefit of U.S. provisional application No. 62/984,341, filed on Mar. 3, 1920, the teachings of which are incorporated herein by reference in their entirety.

BACKGROUND

Field of the Disclosure

The present disclosure relates to sports equipment and, more specifically but not exclusively, to equipment for training athletes to play soccer (i.e., European-style football).

Description of the Related Art

This section introduces aspects that may help facilitate a better understanding of the disclosure. Accordingly, the statements of this section are to be read in this light and are not to be understood as admissions about what is prior art or what is not prior art.

Most, if not all, sports require athletes to be able to use their entire body in order to play to the athlete's maximum ability. Unfortunately, most individuals have (i) a dominant side which they tend to use most and (ii) a non-dominant side which they seldom, if ever, use. As a result, the athlete reduces the optimum use of their entire body while participating in the sport.

In a perfect world, a soccer player should be one-hundred percent ambidextrous, meaning that the player should be capable of using his or her left and right feet with equal skill. This would allow the athlete to have a distinct advantage over his or her opponent who is, most likely, "one-sided." An ambidextrous soccer player will utilize skills such as muscle memory, coordination, and overall confidence, to better oneself for competition. Since the ability to use both feet with equal skill does not come naturally to most individuals, there is a need for methods and devices for assisting soccer players in developing their ability to use their non-dominant side.

BRIEF DESCRIPTION OF THE DRAWINGS

Embodiments of the disclosure will become more fully apparent from the following detailed description, the appended claims, and the accompanying drawings in which like reference numerals identify similar or identical elements.

DETAILED DESCRIPTION

Figure 1:
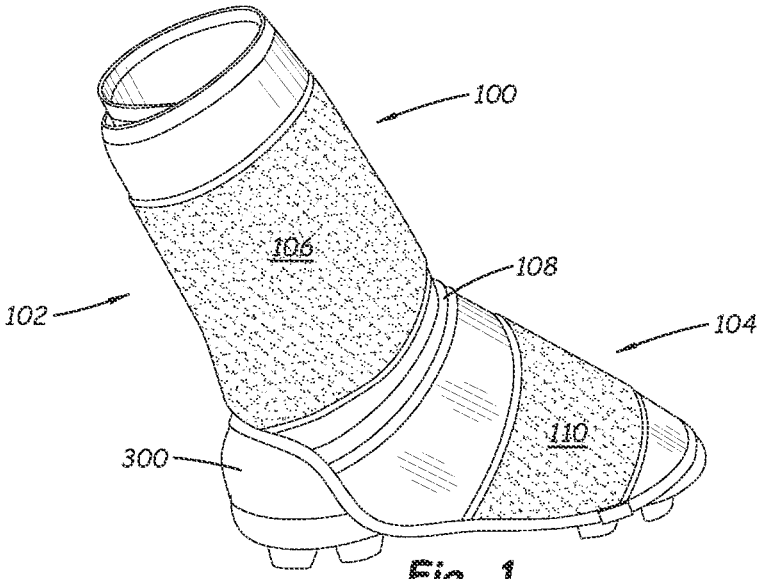
FIGS. 1-4 show perspective views of a soccer training device installed on an athlete's soccer shoe, according to one embodiment of the disclosure.
Figure 2:
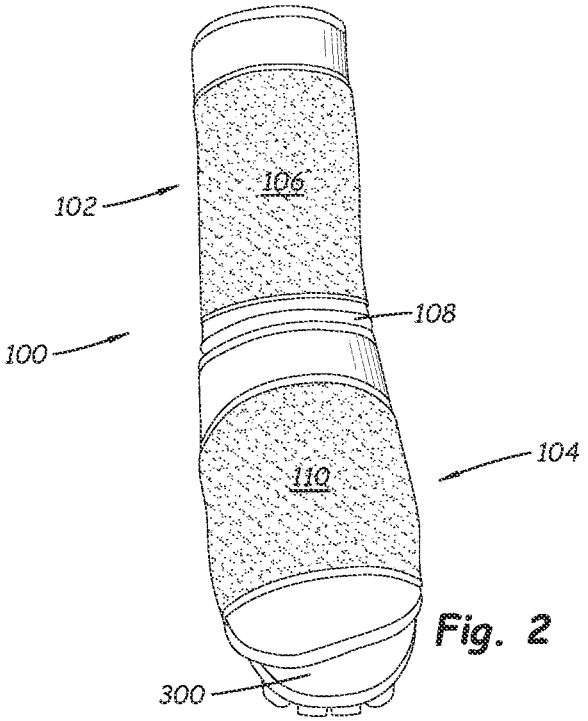
Figure 3:
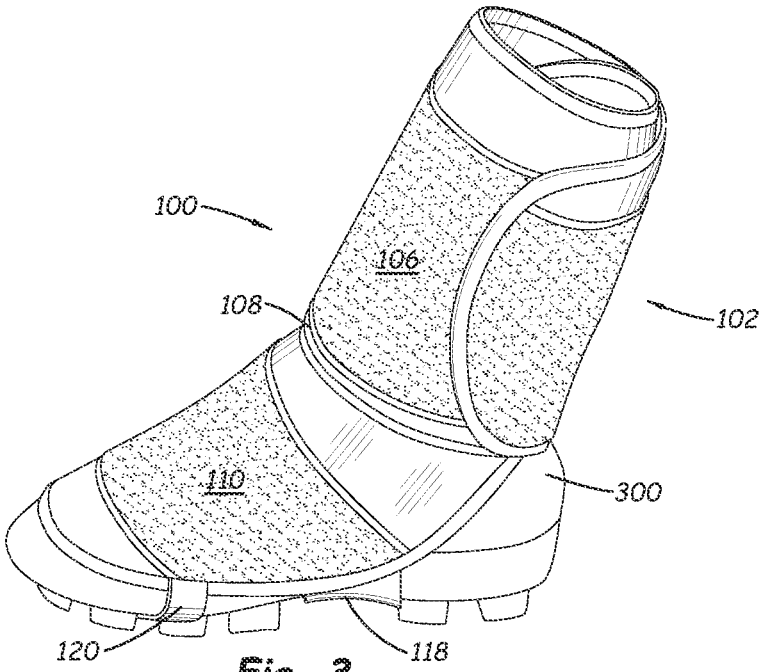

Detailed illustrative embodiments of the present disclosure are disclosed herein. However, specific structural and functional details disclosed herein are merely representative for purposes of describing example embodiments of the present disclosure. The present disclosure may be embodied in many alternate forms and should not be construed as limited to only the embodiments set forth herein. Further, the terminology used herein is for the purpose of describing particular embodiments only and is not intended to be limiting of example embodiments of the disclosure.

As used herein, the singular forms "a," "an," and "the," are intended to include the plural forms as well, unless the context clearly indicates otherwise. It further will be understood that the terms "comprises," "comprising," "contains," "containing," "includes," and/or "including," specify the presence of stated features, steps, or components, but do not preclude the presence or addition of one or more other features, steps, or components. It also should be noted that in some alternative implementations, the functions/acts noted may occur out of the order noted in the figures. For example, two figures shown in succession may in fact be executed substantially concurrently or may sometimes be executed in the reverse order, depending upon the functions/acts involved.

FIGS. 1-4 show perspective views of a soccer training device 100 installed on an athlete's soccer shoe 300, according to one embodiment of the disclosure. The training device 100 comprises a fabric body having an upper portion 102 that wraps around the athlete's lower leg (not shown) and a lower portion 104 that wraps around the lateral (i.e., outer), dorsal (i.e., top), and medial (i.e., inner) sides of the shoe 300. Preferably, the fabric body is made out of materials that are durable, breathable, and flexible. The upper and lower portions 102 and 104 are interconnected by a flexible joint 108 made of, for example, a polyester or nylon tricot material, that is sewn into training device 100 to permit the athlete's foot to flex, e.g., upward and downward, about the ankle. Furthermore, patches 106 and 110 of hook material, such as those associated with Velcro hook-and-loop systems, are sewn onto the upper portion 102 and the lower portion 104, respectively.

Figure 4:
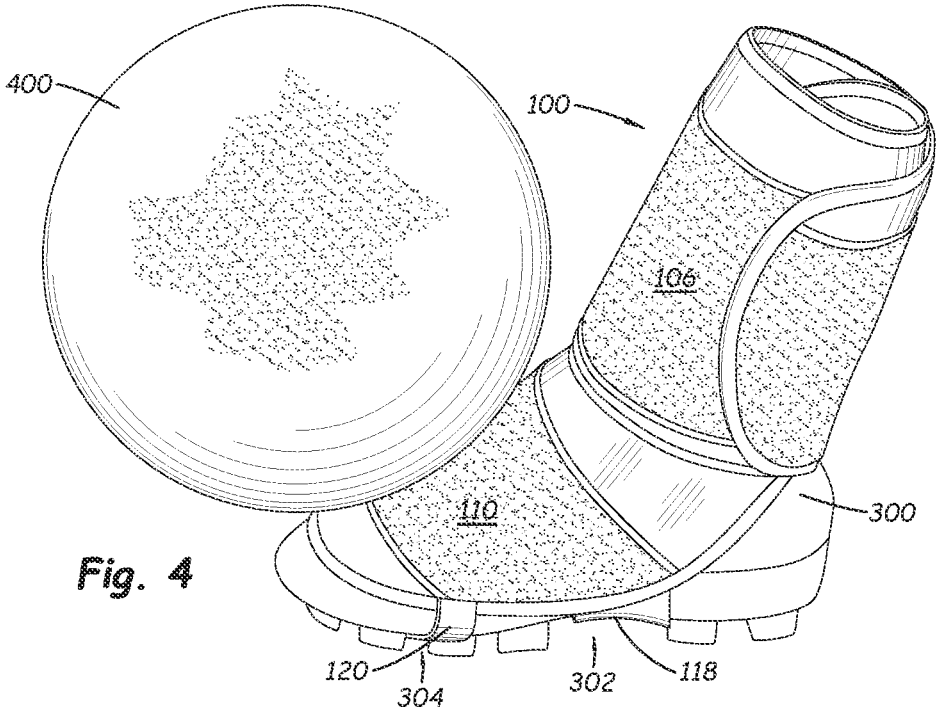

To train an athlete to use his or her non-dominant leg, the training device 100 is attached to the shoe and lower portion of the athlete's dominant leg. As shown in FIG. 4, the training device 100 is used with a soccer ball 400 that is covered in loop material that is capable of engaging with the hook patches 106 and 110 of the training device 100 to form a hook-and-loop assembly. It will be understood that, in alternative embodiments, the training device has patches of loop material, and the soccer ball is covered with hook material.

When the athlete inadvertently uses his or her dominant leg to kick the soccer ball 400, loops on the soccer ball 400 mate with hooks on one or both of the hook patches 106 and 110 on the training device 100. As a result, the soccer ball 400 sticks to the training device 100, rendering the dominant foot useless for kicking. If the soccer ball 400 mates to the training device 100 with sufficiently strong force, then play must be stopped to remove the soccer ball 400 from the training device 100. In any event, rendering the athlete's dominant foot useless for kicking should frustrate the athlete so that the athlete stops using his or her dominant foot, practicing instead to kick with his or her non-dominant foot.

The hook patch 106 extends all the way around the lower portion of the athlete's leg, and the hook patch 110 covers the lateral, dorsal, and medial portions of the shoe 300. Providing such coverage of the leg and shoe ensures that the soccer ball 400 will stick to the athlete's dominant foot when he or she attempts to use it to kick the soccer ball.

Figure 5:
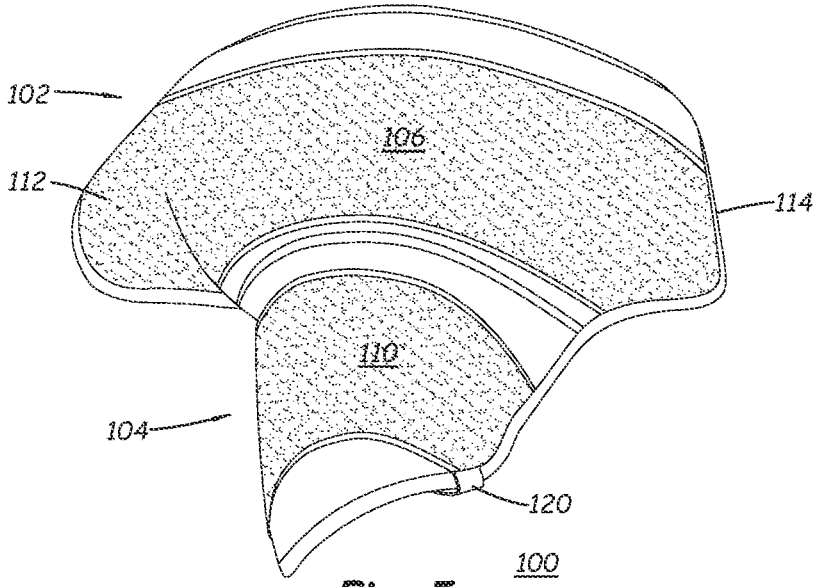
FIGS. 5 and 6 show perspective views of the outside and inside surfaces, respectively, of the unwrapped training device 100 of FIGS. 1-4.
Figure 6:
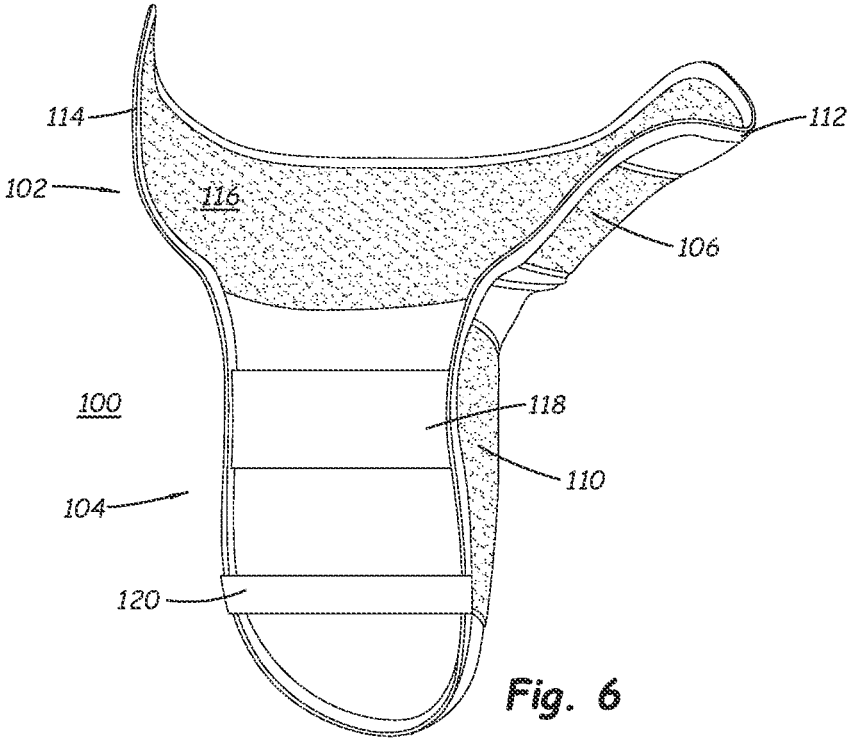

FIGS. 5 and 6 show perspective views of the outside and inside surfaces, respectively, of the unwrapped training device 100 of FIGS. 1-4. As shown, the upper portion 102 of the training device 100 has first and second leg attachment portions 112 and 114, respectively, which wrap around the athlete's leg when installed. When the training device 100 is wrapped around an athlete's leg and shoe, the first and second leg attachment portions 112 and 114 are secured to one another by mating loops 116 on the inside of the second leg attachment portion 114 with hooks on the hook patch 106 on the outside of the first leg attachment portion 112.

The lower portion 104 of the training device 100 has first and second shoe attachment portions (e.g., straps) 118 and 120 that are constructed using elastic bands, the two ends of which are sewn to the sides of lower portion 104. Note that, in alternative embodiments, only one end of the shoe attachment portion 118 and/or 120 is sewn to one side of the lower portion 104, where the other end of the shoe attachment portion 118 and/or 120 is attached to the lower portion 104 using suitable hook-and-loop materials. In these alternative embodiments, the shoe attachment portions may be, but do not need to be made of an elastic material. Note that some embodiments may have only one shoe attachment portion. In one particular embodiment, the first and second shoe attachment portions 118 and 120 are both made of an elastic material, where the first shoe attachment portion 118 is permanently connected at both ends to the lower portion 104, and the second shoe attachment portion 120 is permanently connected to the lower portion 104 at one end, where the other end of the second shoe attachment portion 120 having loop material that engages with the hook material 110 on the lower portion 104 to secure the lower portion 104 on the athlete's shoe 300.

The lower portion 104 is secured to the shoe 300 by sliding the shoe 300 between the first shoe attachment portion 118 and the lower portion 104 such that the first shoe attachment portion 118 comes to rest in space 302 corresponding to an arch portion on the bottom side of the shoe 300 (as shown in FIG. 4) between the front and back sets of spikes, if applicable. Furthermore, the toe of shoe 300 is positioned between the second shoe attachment portion 120 and the lower portion 104 such that the second shoe attachment portion 120 rests in a space 304 between spikes, if applicable, at a toe portion on the bottom side of the shoe 300 (as shown in FIG. 4).

Attaching the training device 100 to both the leg and the shoe enables the athlete to be fully engaged in all of the movements that are necessary for full participation in practice drills and live play.

According to at least some embodiments, the training device 100 is designed such that it may be interchangeably installed on either one of athlete's legs.

In alternative embodiments, the leg attachment portions and shoe attachment portions may be implemented in a manner different from that of the leg attachment portions 112 and 114 and the shoe attachment portions 118 and 120 of the training device 100. For example, the leg attachment portions can be implemented using (i) a band of elastic material, the ends of which are sewn to the sides of the upper portion 102 or (ii) a band of elastic or non-elastic material, one end of which is sewn to one side of the upper portion 102 and a remaining end of which is attached to the other side of the upper portion 102 using suitable hook-and-loop materials or another suitable type of fastener. The leg attachment portions and shoe attachment portions may be implemented in numerous other manners and may use fasteners other than hook-and-loop materials, including, but not limited to, snaps, buckles, and buttons.

Furthermore, in alternative embodiments, hook patch 110 may cover only one or two of the lateral, dorsal, and medial sides of the shoe.

Yet further, in alternative embodiments, the upper portion 102 is not permanently attached to the lower portion 104, such that (i) the upper portion is independently fastened to the athlete's leg or shin guard (and possibly even integrated into the shin guard) and (ii) the lower portion is independently fastened to the athlete's shoe. In some embodiments, the upper and lower portions may be removably attached to one another.

In certain embodiments, the present disclosure is a training device comprising (i) an upper portion configured to be wrapped around an athlete's lower leg and (ii) a lower portion configured to be secured onto a shoe worn on the athlete's foot below the lower leg, wherein an outer surface of at least one of the upper and lower portions has a first material configured to mate with a second material on an outer surface of a ball, such that, when the athlete attempts to kick the ball with the foot, the ball will tend to stick to the training device due to mating of the first and second materials.

In at least some of the above embodiments, the first and second materials form a hook-and-loop system.

In at least some of the above embodiments, the outer surfaces of both the upper and lower portions have the first material.

In at least some of the above embodiments, when the training device is mounted onto the athlete's lower leg and shoe, (i) the first material on the upper portion wraps all the way around the athlete's lower leg and (ii) the first material on the lower portion covers lateral, medial, and dorsal portions of the athlete's shoe.

In at least some of the above embodiments, an inner surface of the upper portion has the second material, such that, when the upper portion is wrapped around the athlete's lower leg, the second material on the inner surface of the upper portion mates with the first material on the outer surface of the upper portion to secure the upper portion around the athlete's lower leg.

In at least some of the above embodiments, the lower portion comprises at least one strap configured to wrap around the bottom side of the shoe to secure the lower portion on the shoe.

In at least some of the above embodiments, the lower portion comprises (i) a first strap configured to be positioned at an arch portion on the bottom side of the shoe and (ii) a second strap configured to be positioned at a toe portion on the bottom of the shoe, wherein the first and second straps secure the lower portion on the shoe.

In at least some of the above embodiments, the at least one strap comprises an elastic material, wherein each end of the first elastic strap is permanently connected to a different side of the lower portion in order to secure the lower portion on the shoe.

In at least some of the above embodiments, a first end of the at least one strap is permanently connected to a first side of the lower portion and a second end of the at least one strap is adapted to be removably connected to a second side of the lower portion in order to secure the lower portion on the shoe.

In at least some of the above embodiments, the second end of the at least one strap has the second material configured to mate with the first material on the outer surface of the lower portion to removably connect the second end of the first strap to the second side of the lower portion.

In at least some of the above embodiments, the upper and lower portions are interconnected by a flexible material forming a flexible joint that enables the athlete's ankle to flex the athlete's foot with respect to the athlete's leg.

In at least some of the above embodiments, the training device is adapted to be selectively mounted onto the athlete's left leg and left shoe or the athlete's right leg and right shoe.

Unless explicitly stated otherwise, each numerical value and range should be interpreted as being approximate as if the word "about" or "approximately" preceded the value or range.

It will be further understood that various changes in the details, materials, and arrangements of the parts which have been described and illustrated in order to explain embodiments of this disclosure may be made by those skilled in the art without departing from embodiments of the disclosure encompassed by the following claims.

In this specification including any claims, the term "each" may be used to refer to one or more specified characteristics of a plurality of previously recited elements or steps. When used with the open-ended term "comprising," the recitation of the term "each" does not exclude additional, unrecited elements or steps. Thus, it will be understood that an apparatus may have additional, unrecited elements and a method may have additional, unrecited steps, where the additional, unrecited elements or steps do not have the one or more specified characteristics.

The use of figure numbers and/or figure reference labels in the claims is intended to identify one or more possible embodiments of the claimed subject matter in order to facilitate the interpretation of the claims. Such use is not to be construed as necessarily limiting the scope of those claims to the embodiments shown in the corresponding figures.

Reference herein to "one embodiment" or "an embodiment" means that a particular feature, structure, or characteristic described in connection with the embodiment can be included in at least one embodiment of the disclosure. The appearances of the phrase "in one embodiment" in various places in the specification are not necessarily all referring to the same embodiment, nor are separate or alternative embodiments necessarily mutually exclusive of other embodiments. The same applies to the term "implementation."

The embodiments covered by the claims in this application are limited to embodiments that (1) are enabled by this specification and (2) correspond to statutory subject matter. Non-enabled embodiments and embodiments that correspond to non-statutory subject matter are explicitly disclaimed even if they fall within the scope of the claims.

Unless otherwise specified herein, the use of the ordinal adjectives "first," "second," "third," etc., to refer to an object of a plurality of like objects merely indicates that different instances of such like objects are being referred to, and is not intended to imply that the like objects so referred-to have to be in a corresponding order or sequence, either temporally, spatially, in ranking, or in any other manner.

What is claimed is:

1. A training device comprising:

an upper portion configured to be wrapped around an athlete's lower leg; and a lower portion configured to be secured onto a shoe worn on the athlete's foot below the lower leg, wherein an outer surface of at least one of the upper and lower portions has a first material configured to mate with a second material on an outer surface of a ball, such that, when the athlete attempts to kick the ball with the foot, the ball will tend to stick to the training device due to mating of the first and second materials.

2. The training device of claim 1, wherein the first and second materials form a hook-and-loop system.

3. The training device of claim 1, wherein the outer surfaces of both the upper and lower portions have the first material.

4. The training device of claim 3, wherein, when the training device is mounted onto the athlete's lower leg and shoe:

the first material on the upper portion wraps all the way around the athlete's lower leg; and the first material on the lower portion covers lateral, medial, and dorsal portions of the athlete's shoe.

5. The training device of claim 1, wherein an inner surface of the upper portion has the second material, such that, when the upper portion is wrapped around the athlete's lower leg, the second material on the inner surface of the upper portion mates with the first material on the outer surface of the upper portion to secure the upper portion around the athlete's lower leg.

6. The training device of claim 1, wherein the lower portion comprises at least one strap configured to wrap around the bottom side of the shoe to secure the lower portion on the shoe.

7. The training device of claim 6, wherein the lower portion comprises:

a first strap configured to be positioned at an arch portion on the bottom side of the shoe; and a second strap configured to be positioned at a toe portion on the bottom of the shoe, wherein the first and second straps secure the lower portion on the shoe.

8. The training device of claim 6, wherein the at least one strap comprises an elastic material, wherein each end of the at least one strap is permanently connected to a different side of the lower portion in order to secure the lower portion on the shoe.

9. The training device of claim 6, wherein a first end of the at least one strap is permanently connected to a first side of the lower portion and a second end of the at least one strap is adapted to be removably connected to a second side of the lower portion in order to secure the lower portion on the shoe.

10. The training device of claim 9, wherein the second end of the at least one strap has the second material configured to mate with the first material on the outer surface of the lower portion to removably connect the second end of the first strap to the second side of the lower portion.

11. The training device of claim 1, wherein the upper and lower portions are interconnected by a flexible material forming a flexible joint that enables the athlete's ankle to flex the athlete's foot with respect to the athlete's leg.

12. The training device of claim 1, wherein the training device is adapted to be selectively mounted onto the athlete's left leg and left shoe or the athlete's right leg and right shoe.

13. The training device of claim 1, wherein:

the first and second materials form a hook-and-loop system;

the outer surfaces of both the upper and lower portions have the first material;

when the training device is mounted onto the athlete's lower leg and shoe:

the first material on the upper portion wraps all the way around the athlete's lower leg; and the first material on the lower portion covers lateral, medial, and dorsal portions of the athlete's shoe;

an inner surface of the upper portion has the second material, such that, when the upper portion is wrapped around the athlete's lower leg, the second material on the inner surface of the upper portion mates with the first material on the outer surface of the upper portion to secure the upper portion around the athlete's lower leg;

the lower portion comprises at least one strap configured to wrap around the bottom side of the shoe to secure the lower portion on the shoe;

the upper and lower portions are interconnected by a flexible material forming a flexible joint that enables the athlete's ankle to flex the athlete's foot with respect to the athlete's leg; and the training device is adapted to be selectively mounted onto the athlete's left leg and left shoe or the athlete's right leg and right shoe.

14. The training device of claim 13, wherein the lower portion comprises:

a first strap configured to be positioned at an arch portion on the bottom side of the shoe; and a second strap configured to be positioned at a toe portion on the bottom of the shoe, wherein the first and second straps secure the lower portion on the shoe.

15. The training device of claim 13, wherein the at least one strap comprises an elastic material, wherein each end of the at least one strap is permanently connected to a different side of the lower portion in order to secure the lower portion on the shoe.

16. The training device of claim 13, wherein:

a first end of the at least one strap is permanently connected to a first side of the lower portion and a second end of the at least one strap is adapted to be removably connected to a second side of the lower portion in order to secure the lower portion on the shoe; and the second end of the at least one strap has the second material configured to mate with the first material on the outer surface of the lower portion to removably connect the second end of the first strap to the second side of the lower portion.

17. A method for training an athlete to use the athlete's non-dominant foot using the training device of claim 1, the method comprising:

wrapping the upper portion of the training device of claim 1 around the athlete's dominant lower leg; and securing the lower portion of the training device of claim 1 onto a shoe worn on the athlete's dominant foot below the dominant lower leg, such that, when the athlete attempts to kick the ball of claim 1 with the athlete's dominant foot, the ball will tend to stick to the training device due to the mating of the first and second materials, thereby discouraging the athlete from kicking the ball with the athlete's dominant foot and encouraging the athlete to kick the ball with the athlete's non-dominant foot.

18. The method of claim 17, wherein:

the first and second materials form a hook-and-loop system;

the outer surfaces of both the upper and lower portions have the first material;

when the training device is mounted onto the athlete's dominant lower leg and shoe:

the first material on the upper portion wraps all the way around the athlete's dominant lower leg; and the first material on the lower portion covers lateral, medial, and dorsal portions of the athlete's shoe;

an inner surface of the upper portion has the second material, such that, when the upper portion is wrapped around the athlete's dominant lower leg, the second material on the inner surface of the upper portion mates with the first material on the outer surface of the upper portion to secure the upper portion around the athlete's dominant lower leg;

the lower portion comprises at least one strap configured to wrap around the bottom side of the shoe to secure the lower portion on the shoe;

the upper and lower portions are interconnected by a flexible material forming a flexible joint that enables the athlete's dominant ankle to flex the athlete's dominant foot with respect to the athlete's dominant leg; and the training device is adapted to be selectively mounted onto a first athlete's dominant left leg and left shoe or a second athlete's dominant right leg and right shoe.

19. The method of claim 18, wherein the lower portion comprises:

a first strap configured to be positioned at an arch portion on the bottom side of the shoe; and a second strap configured to be positioned at a toe portion on the bottom of the shoe, wherein the first and second straps secure the lower portion on the shoe.

20. The method of claim 18, wherein the at least one strap comprises an elastic material, wherein each end of the at least one strap is permanently connected to a different side of the lower portion in order to secure the lower portion on the shoe.

21. The method of claim 18, wherein;

a first end of the at least one strap is permanently connected to a first side of the lower portion and a second end of the at least one strap is adapted to be removably connected to a second side of the lower portion in order to secure the lower portion on the shoe; and the second end of the at least one strap has the second material configured to mate with the first material on the outer surface of the lower portion to removably connect the second end of the first strap to the second side of the lower portion.

* * * * *